US005643662A

United States Patent [19]

Yeo et al.

[11] Patent Number: 5,643,662

[45] Date of Patent: Jul. 1, 1997

[54] HYDROPHILIC, MULTICOMPONENT POLYMERIC STRANDS AND NONWOVEN FABRICS MADE THEREWITH

[75] Inventors: Richard Swee-chye Yeo, Dunwoody; Christopher Cosgrove Creagan, Marietta, both of Ga.

[73] Assignee: Kimberly-Clark Corporation, Neenah, Wis.

[21] Appl. No.: 186,394

[22] Filed: Jan. 21, 1994

Related U.S. Application Data

[63] Continuation of Ser. No. 974,554, Nov. 12, 1992, abandoned.

[51] Int. Cl.[6] ..... C08L 33/02; B32B 27/00; D02G 3/00

[52] U.S. Cl. ..... 442/361; 428/365; 428/373; 525/221; 442/362; 442/364

[58] Field of Search ..... 428/284, 286, 428/365, 373; 525/221

[56] References Cited

U.S. PATENT DOCUMENTS

| | | | |
|---|---|---|---|
| Re. 30,955 | 6/1982 | Stanistreet | 156/308.2 |
| Re. 31,825 | 2/1985 | Mason et al. | 428/198 |
| 2,931,091 | 4/1960 | Breen | 28/82 |
| 2,987,797 | 6/1961 | Breen | 28/82 |
| 3,038,235 | 6/1962 | Zimmerman | 28/82 |
| 3,038,236 | 6/1962 | Breen | 28/82 |
| 3,038,237 | 6/1962 | Taylor, Jr. | 28/82 |
| 3,377,232 | 4/1968 | Meacock et al. | 161/155 |
| 3,423,266 | 1/1969 | Davies et al. | 156/167 |
| 3,551,271 | 12/1970 | Thomas et al. | 161/150 |
| 3,589,956 | 6/1971 | Kranz et al. | 156/62.4 |
| 3,595,731 | 7/1971 | Davies et al. | 161/150 |
| 3,616,160 | 10/1971 | Wincklhofer | 161/150 |
| 3,692,618 | 9/1972 | Dorschner et al. | 161/72 |
| 3,725,192 | 4/1973 | Ando et al. | 161/175 |
| 3,760,046 | 9/1973 | Schwartz et al. | 264/47 |

(List continued on next page.)

FOREIGN PATENT DOCUMENTS

| | | |
|---|---|---|
| 612156 | 1/1961 | Canada . |
| 618040 | 4/1961 | Canada . |
| 769644 | 10/1967 | Canada . |
| 792651 | 8/1968 | Canada . |
| 829845 | 12/1969 | Canada . |
| 846761 | 7/1970 | Canada . |
| 847771 | 7/1970 | Canada . |
| 852100 | 9/1970 | Canada . |
| 854076 | 10/1970 | Canada . |
| 896214 | 3/1972 | Canada . |
| 903582 | 6/1972 | Canada . |

(List continued on next page.)

OTHER PUBLICATIONS

"Thermobonding Fibers for Nonwovens" by S. Tomioka, Nonwovens Industry, May 1981, pp. 23–31.

*Primary Examiner*—Thurman K. Page
*Assistant Examiner*—Kathryne E. Shelborne
*Attorney, Agent, or Firm*—William D. Herrick

[57] ABSTRACT

A hydrophilic melt-extruded multicomponent polymeric strand including a first melt-extrudable polymeric component and a second melt-extrudable, hydrophilic polymeric component, the first and second components being arranged in substantially distinct zones across the cross-section of the multicomponent strand and extending continuously along the length of the multicomponent strand, the second component constituting at least a portion of the peripheral surface of the multicomponent strand continuously along the length of the multicomponent strand. The second component renders the strand hydrophilic and preferably has a critical surface tension at 20° C. greater than about 55 dyne/cc, and more preferably greater than about 65 dyne/cc. A suitable hydrophilic second component comprises a block copolymer of nylon 6 and polyethylene oxide diamine. Suitable polymers for the first component include linear polycondensates and crystalline polyolefins such as polypropylene. Nonwoven fabrics and absorbent articles made with the hydrophilic multicomponent polymeric strands are also disclosed.

32 Claims, 1 Drawing Sheet

U.S. PATENT DOCUMENTS

| | | | |
|---|---|---|---|
| 3,802,817 | 4/1974 | Matsuki et al. | 425/66 |
| 3,824,146 | 7/1974 | Ellis | 161/150 |
| 3,855,045 | 12/1974 | Brock | 161/146 |
| 3,895,151 | 7/1975 | Matthews et al. | 428/102 |
| 3,900,678 | 8/1975 | Aishima et al. | 428/374 |
| 3,940,302 | 2/1976 | Matthews et al. | 156/167 |
| 3,992,499 | 11/1976 | Lee | 264/78 |
| 4,005,169 | 1/1977 | Cumbers | 264/103 |
| 4,068,036 | 1/1978 | Stanistreet | 428/296 |
| 4,076,698 | 2/1978 | Anderson et al. | 526/348.6 |
| 4,086,112 | 4/1978 | Porter | 156/73.1 |
| 4,088,726 | 5/1978 | Cumbers | 264/123 |
| 4,119,447 | 10/1978 | Ellis et al. | 156/73.1 |
| 4,154,357 | 5/1979 | Sheard et al. | 220/88 A |
| 4,170,680 | 10/1979 | Cumbers | 428/195 |
| 4,181,762 | 1/1980 | Benedyk | 428/97 |
| 4,188,436 | 2/1980 | Ellis et al. | 428/198 |
| 4,189,338 | 2/1980 | Ejima et al. | 156/167 |
| 4,195,112 | 3/1980 | Sheard et al. | 428/288 |
| 4,211,816 | 7/1980 | Booker et al. | 428/296 |
| 4,211,819 | 7/1980 | Kunimune et al. | 428/374 |
| 4,216,772 | 8/1980 | Tsuchiya et al. | 128/284 |
| 4,234,655 | 11/1980 | Kunimune et al. | 428/374 |
| 4,258,097 | 3/1981 | Benedyk | 428/224 |
| 4,269,888 | 5/1981 | Ejima et al. | 428/296 |
| 4,285,748 | 8/1981 | Booker et al. | 156/167 |
| 4,306,929 | 12/1981 | Menikheim et al. | 156/290 |
| 4,315,881 | 2/1982 | Nakajima et al. | 264/171 |
| 4,323,626 | 4/1982 | Kunimune et al. | 428/274 |
| 4,340,563 | 7/1982 | Appel et al. | 264/518 |
| 4,356,220 | 10/1982 | Benedyk | 428/17 |
| 4,362,777 | 12/1982 | Miller | 428/224 |
| 4,369,156 | 1/1983 | Mathes et al. | 264/147 |
| 4,373,000 | 2/1983 | Knoke et al. | 428/198 |
| 4,381,326 | 4/1983 | Kelly | 428/134 |
| 4,396,452 | 8/1983 | Menikheim et al. | 156/290 |
| 4,419,160 | 12/1983 | Wang et al. | 156/73.2 |
| 4,434,204 | 2/1984 | Hartman et al. | 428/198 |
| 4,451,520 | 5/1984 | Tecl et al. | 428/198 |
| 4,469,540 | 9/1984 | Furukawa et al. | 156/62.4 |
| 4,477,516 | 10/1984 | Sugihara et al. | 428/296 |
| 4,480,000 | 10/1984 | Watanabe et al. | 428/284 |
| 4,483,897 | 11/1984 | Fujimura et al. | 428/288 |
| 4,485,141 | 11/1984 | Fujimura et al. | 428/288 |
| 4,496,508 | 1/1985 | Hartmann et al. | 264/167 |
| 4,500,384 | 2/1985 | Tomioka et al. | 156/290 |
| 4,504,539 | 3/1985 | Petracek et al. | 428/195 |
| 4,511,615 | 4/1985 | Ohta | 428/198 |
| 4,520,066 | 5/1985 | Athey | 428/288 |
| 4,530,353 | 7/1985 | Lauritzen | 128/156 |
| 4,546,040 | 10/1985 | Knotek et al. | 428/370 |
| 4,547,420 | 10/1985 | Krueger et al. | 428/229 |
| 4,551,378 | 11/1985 | Carey, Jr. | 428/198 |
| 4,552,603 | 11/1985 | Harris, Jr. et al. | 156/167 |
| 4,555,430 | 11/1985 | Mays | 428/134 |
| 4,555,811 | 12/1985 | Shimalla | 2/51 |
| 4,557,972 | 12/1985 | Okamoto et al. | 428/373 |
| 4,588,630 | 5/1986 | Shimalla | 428/131 |
| 4,595,629 | 6/1986 | Mays | 428/286 |
| 4,617,235 | 10/1986 | Shinonome et al. | 428/374 |
| 4,632,858 | 12/1986 | Knoke et al. | 428/287 |
| 4,644,045 | 2/1987 | Fowells | 526/348 |
| 4,656,075 | 4/1987 | Mudge | 428/110 |
| 4,657,804 | 4/1987 | Mays et al. | 428/212 |
| 4,663,220 | 5/1987 | Wisneski et al. | 428/221 |
| 4,681,801 | 7/1987 | Eian et al. | 428/283 |
| 4,684,570 | 8/1987 | Malaney | 428/296 |
| 4,713,134 | 12/1987 | Mays et al. | 156/181 |
| 4,713,291 | 12/1987 | Sasaki et al. | 428/373 |
| 4,722,857 | 2/1988 | Tomioka et al. | 428/113 |
| 4,731,277 | 3/1988 | Groitzsch et al. | 428/137 |
| 4,737,404 | 4/1988 | Jackson | 428/284 |
| 4,749,423 | 6/1988 | Vaalburg et al. | 156/181 |
| 4,755,179 | 7/1988 | Shiba et al. | 604/370 |
| 4,756,786 | 7/1988 | Malaney | 156/308.2 |
| 4,770,925 | 9/1988 | Uchikawa et al. | 428/219 |
| 4,774,124 | 9/1988 | Shimalla et al. | 428/171 |
| 4,774,277 | 9/1988 | Janac et al. | 524/474 |
| 4,787,947 | 11/1988 | Mays | 156/160 |
| 4,789,699 | 12/1988 | Kieffer et al. | 524/271 |
| 4,795,559 | 1/1989 | Shinjou et al. | 210/490 |
| 4,795,668 | 1/1989 | Krueger et al. | 428/174 |
| 4,804,577 | 2/1989 | Hazelton et al. | 428/224 |
| 4,808,202 | 2/1989 | Nishikawa et al. | 55/390 |
| 4,814,032 | 3/1989 | Taniguchi et al. | 156/167 |
| 4,818,587 | 4/1989 | Ejima et al. | 428/198 |
| 4,830,904 | 5/1989 | Gessner et al. | 428/219 |
| 4,839,228 | 6/1989 | Jezic et al. | 428/401 |
| 4,840,846 | 6/1989 | Ejima et al. | 428/373 |
| 4,840,847 | 6/1989 | Ohmae et al. | 428/373 |
| 4,851,284 | 7/1989 | Yamanoi et al. | 428/284 |
| 4,872,870 | 10/1989 | Jackson | 604/366 |
| 4,874,447 | 10/1989 | Hazelton et al. | 156/167 |
| 4,874,666 | 10/1989 | Kubo et al. | 428/398 |
| 4,880,691 | 11/1989 | Sawyer et al. | 428/225 |
| 4,883,707 | 11/1989 | Newkirk | 428/219 |
| 4,909,975 | 3/1990 | Sawyer et al. | 264/210.7 |
| 4,966,808 | 10/1990 | Kawano | 428/224 |
| 4,981,749 | 1/1991 | Kubo et al. | 428/219 |
| 4,997,611 | 3/1991 | Hartmann | 264/210.8 |
| 5,001,813 | 3/1991 | Rodini | 19/0.46 |
| 5,002,815 | 3/1991 | Yamanaka et al. | 428/109 |
| 5,068,141 | 11/1991 | Kubo et al. | 428/219 |
| 5,069,970 | 12/1991 | Largman et al. | 428/373 |
| 5,082,720 | 1/1992 | Hayes | 428/224 |
| 5,108,276 | 4/1992 | Hartmann | 425/66 |
| 5,108,820 | 4/1992 | Kaneko et al. | 428/198 |
| 5,108,827 | 4/1992 | Gessner | 428/219 |
| 5,125,818 | 6/1992 | Yeh | 425/131.5 |
| 5,126,201 | 6/1992 | Shiba et al. | 428/389 |

FOREIGN PATENT DOCUMENTS

| | | |
|---|---|---|
| 959221 | 12/1974 | Canada . |
| 959225 | 12/1974 | Canada . |
| 989720 | 5/1976 | Canada . |
| 1051161 | 3/1979 | Canada . |
| 1058818 | 7/1979 | Canada . |
| 1060173 | 8/1979 | Canada . |
| 1071943 | 2/1980 | Canada . |
| 1081905 | 7/1980 | Canada . |
| 1103869 | 6/1981 | Canada . |
| 1109202 | 9/1981 | Canada . |
| 0 070 163 | 7/1982 | Canada . |
| 1128411 | 7/1982 | Canada . |
| 1133771 | 10/1982 | Canada . |
| 1140406 | 2/1983 | Canada . |
| 1143930 | 4/1983 | Canada . |
| 1145213 | 4/1983 | Canada . |
| 1145515 | 5/1983 | Canada . |
| 1148302 | 6/1983 | Canada . |
| 1172814 | 8/1984 | Canada . |
| 1174039 | 9/1984 | Canada . |
| 1175219 | 10/1984 | Canada . |
| 1178524 | 11/1984 | Canada . |
| 1182692 | 2/1985 | Canada . |
| 1204641 | 5/1986 | Canada . |
| 1218225 | 2/1987 | Canada . |
| 1226486 | 9/1987 | Canada . |
| 1230720 | 12/1987 | Canada . |
| 1230810 | 12/1987 | Canada . |
| 1286464 | 12/1987 | Canada . |
| 1234535 | 3/1988 | Canada . |

| | | |
|---|---|---|
| 1235292 | 4/1988 | Canada . |
| 1237884 | 6/1988 | Canada . |
| 1250412 | 2/1989 | Canada . |
| 1257768 | 7/1989 | Canada . |
| 1259175 | 9/1989 | Canada . |
| 2001091 | 10/1989 | Canada . |
| 2011599 | 3/1990 | Canada . |
| 1267273 | 4/1990 | Canada . |
| 1272945 | 8/1990 | Canada . |
| 1273188 | 8/1990 | Canada . |
| 2067398 | 8/1990 | Canada . |
| 1284424 | 5/1991 | Canada . |
| 1285130 | 6/1991 | Canada . |
| 0 013 127 | 12/1979 | European Pat. Off. . |
| 0 029 666 | 10/1980 | European Pat. Off. . |
| 0 078 869 | 11/1981 | European Pat. Off. . |
| 0 070 164 | 7/1982 | European Pat. Off. . |
| 0093021 | 11/1983 | European Pat. Off. . |
| 0 127 483 | 5/1984 | European Pat. Off. . |
| 0 132 110 | 7/1984 | European Pat. Off. . |
| 0 134 141 | 8/1984 | European Pat. Off. . |
| 0 171 806 | 8/1985 | European Pat. Off. . |
| 0 171 807 | 8/1985 | European Pat. Off. . |
| 0 233 767 | 2/1987 | European Pat. Off. . |
| 0 264 112 | 10/1987 | European Pat. Off. . |
| 0 275 047 | 1/1988 | European Pat. Off. . |
| 0 290 945 | 5/1988 | European Pat. Off. . |
| 0 334 579 | 3/1989 | European Pat. Off. . |
| 0 311 860 | 4/1989 | European Pat. Off. . |
| 0 337 296 | 4/1989 | European Pat. Off. . |
| 0 340 763 | 5/1989 | European Pat. Off. . |
| 0 340 982 | 4/1989 | European Pat. Off. . |
| 0 351 318 | 7/1989 | European Pat. Off. . |
| 0 366 379 | 10/1989 | European Pat. Off. . |
| 0 423 395A1 | 12/1989 | European Pat. Off. . |
| 0 372 572 | 12/1989 | European Pat. Off. . |
| 0 391 260 | 3/1990 | European Pat. Off. . |
| 0 394 954 | 4/1990 | European Pat. Off. . |
| 0 395 336 | 4/1990 | European Pat. Off. . |
| 0 404 032 | 6/1990 | European Pat. Off. . |
| 0 409 581A2 | 7/1990 | European Pat. Off. . |
| 0 413 280A2 | 8/1990 | European Pat. Off. . |
| 0 421 734A2 | 10/1990 | European Pat. Off. . |
| 0 444 671A3 | 2/1991 | European Pat. Off. . |
| 0 434 029 | 6/1991 | European Pat. Off. . |
| 2171172 | 2/1993 | France . |
| 1560661 | 7/1964 | Germany . |
| 1922089 | 4/1969 | Germany . |
| 1946648 | 9/1969 | Germany . |
| 2156990 | 11/1971 | Germany . |
| 2644961 | 10/1976 | Germany . |
| 3007343 | 2/1980 | Germany . |
| 3544523 | 12/1985 | Germany . |
| 3941824 | 12/1990 | Germany . |
| 1-246413 | 10/1989 | Japan . |
| 2-234967 | 2/1990 | Japan . |
| 903666 | 5/1990 | South Africa . |
| 1035908 | 7/1962 | United Kingdom . |
| 1328634 | 8/1973 | United Kingdom . |
| 1406252 | 9/1975 | United Kingdom . |
| 1408392 | 10/1975 | United Kingdom . |
| 1452654 | 10/1976 | United Kingdom . |
| 1453701 | 10/1976 | United Kingdom . |
| 1534736 | 12/1978 | United Kingdom . |
| 1543905 | 4/1979 | United Kingdom . |
| 1564550 | 4/1980 | United Kingdom . |
| 2139227 | 11/1984 | United Kingdom . |
| 2143867 | 2/1985 | United Kingdom . |
| WO84/03833 | 10/1984 | WIPO . |
| WO87/02719 | 5/1987 | WIPO . |
| WO89/10394 | 11/1989 | WIPO . |

HYDROPHILIC, MULTICOMPONENT POLYMERIC STRANDS AND NONWOVEN FABRICS MADE THEREWITH

This application is a continuation of application Ser. No. 07/974,554 filed on Nov. 12, 1992 now abandoned.

TECHNICAL FIELD

This invention generally relates to polymeric fibers and filaments and products such as nonwoven fabrics made with polymeric fibers and filaments. More particularly, this invention relates to wettable polymeric fibers and filaments and nonwoven fabrics made with such fibers and filaments.

BACKGROUND OF THE INVENTION

Polymeric fibers and filaments are used to make a variety of products including yarns, carpets, woven fabrics, and nonwoven fabrics. As used herein, polymeric fibers and filaments are referred to generically as polymeric strands. Filaments mean continuous strands of material and fibers mean cut or discontinuous strands having a definite length.

Some products made with polymeric strands must be wettable with water or aqueous solutions. In other words, some products made with polymeric strands must be hydrophilic. Nonwoven fabrics are particularly suited for making hydrophilic products. Such products include towels, wipes, and absorbent personal care products including infant care items such as diapers, child care items such as training pants, feminine care items such as sanitary napkins, and adult care items such as incontinence products. Typical polymers used to make wettable nonwoven fabric include linear polycondensates such as polyamides, polyesters and polyurethanes and crystalline polyolefins such as polyethylene, polypropylene, and copolymers of ethylene and propylene. However, such polymers are naturally hydrophobic and must be treated to become hydrophilic.

Methods for treating hydrophobic polymeric strands and materials made therewith include solution coating of wetting agents, internal incorporation of wetting agents, and plasma treatment. These methods are effective but suffer some drawbacks. For example, wetting agents, whether in a surface coating or internally incorporated into the polymer, are fugitive and wash-off of the material after one or more wettings. Once the surface agent has been washed-off the polymer, the polymer becomes hydrophobic again and repels water. Plasma treatment is slow and costly and thus commercially impractical.

Naturally hydrophilic polymers for making polymeric strands are known. These polymers do not require any treatment to become wettable but suffer from some disadvantages. For example, U.S. Pat. Nos. 4,163,078; 4,257,999; and 4,810,449 each disclose hydrophilic filaments or fibers made by solution spinning acrylonitrile copolymers. Solution spinning is relatively costly and requires the use of organic solvents which are a potential environmental hazard. Melt-extruded, hydrophilic fibers for making fibers and filaments are known, but are uncommon and expensive and thus are not normally commercially feasible.

Therefore, there is a need for low-cost, permanently hydrophilic polymeric fibers and filaments and products such as nonwovens made therewith.

SUMMARY OF THE INVENTION

Accordingly, an object of the present invention is to provide improved polymeric strands and products made therewith such as nonwovens and absorbent articles.

Another object of the present invention is to provide permanently hydrophilic polymeric strands and products made therewith.

A further object of the present invention is to provide permanently hydrophilic polymeric strands and products made therewith without the use of surfactant treatments or other conventional treatment methods.

Another object of the present invention is to provide permanently hydrophilic polymeric strands and products made therewith without the use of wet spinning methods.

Still another object of the present invention is to provide permanently hydrophilic polymeric strands and the products made therewith more economically.

Therefore, there is provided a melt-extrudable, multicomponent polymeric strand including a melt-extrudable, hydrophilic polymeric component present in an amount sufficient to render the strand hydrophilic. The remaining portion of the strand can then be made from a polymer which is less expensive than the hydrophilic component so that the overall cost of the strand is commercially practical. The present invention also contemplates a nonwoven fabric made with the above-described melt-extrudable, multicomponent, hydrophilic strands and absorbent articles made with such fabric.

More particularly, the melt-extruded, multicomponent polymeric strand of the present invention includes a first melt-extrudable polymeric component and a second melt-extrudable, hydrophilic polymeric component, the first and second components being arranged in substantially distinct zones across the cross-section of the multicomponent strand and extending continuously along the length of the multicomponent strand, the second component constituting at least a portion of the peripheral surface of the multicomponent strand continuously along the length of the multicomponent strand. Because the polymeric strand of the present invention includes a hydrophilic polymeric component, no surfactant treatment or plasma treatment is necessary to make the strand hydrophilic. Without having to use such conventional treatments, the strand of the present invention can be made more economically. In addition, because the polymeric strand of the present invention is melt-extruded and not solution spun, the strand of the present invention is made without the use of organic solvents and therefore is mole economical and safe for the environment than solution spun strands.

The polymeric strand of the present invention may be arranged in a side-by-side configuration or in a sheath/core configuration; however, the first and second components are preferably arranged in a sheath/core configuration, the first component forming the core and the second component forming the sheath so that the second hydrophilic component forms the peripheral surface of the multicomponent strand. With the second hydrophilic component forming the peripheral surface of the multicomponent strand, the multicomponent strand is substantially completely hydrophilic.

The melt-extrudable, first component of the multicomponent polymeric strand of the present invention can be hydrophobic because it is the second component that renders the strand hydrophilic. Suitable polymers for the first component are melt-extrudable and include linear polycondensates and crystalline polyolefins. The first component preferably has a considerably lower cost than the second component so that the overall cost of the strand is low. Particularly suitable polymers for the first component include polypropylene, polyethylene, copolymers of ethylene and propylene, polyethylene terephthalate, and polyamides.

The second component is melt-extrudable and hydrophilic. As used herein, hydrophilic means wettable with water or an aqueous solution. Suitable polymers for the second component are those on whose surface water or an aqueous solution will wet-out. Generally, to be wettable, the polymer must have a critical surface tension substantially equal to or greater than the surface tension of the liquid. The second component of the present invention preferably has a critical surface tension at 20° C. greater than about 55 dyne/cm. More preferably, the second component of the present invention has a critical surface tension at 20° C. greater than about 65 dyne/cm. Preferably, the second component comprises a block copolymer of nylon 6 and polyethylene oxide diamine. Other suitable polymers for the second component are ethylene acrylic acid and its neutralized salts.

Preferably, the first component of the polymeric strand of the present invention is present in an amount from about 50 to 95% by weight of the strand and the second component is present in an amount from about 50 to about 5% of the strand. More preferably, the first component of the polymeric strand of the present invention is present in an amount from about 50 to 85% by weight of the strand and the second component is present in an amount from about 50 to about 15% of the strand.

The nonwoven fabric of the present invention comprises the above-described melt-extruded multicomponent polymeric strands and may be made by conventional techniques for making nonwovens such as melt spinning followed by bonding. The absorbent articles of the present invention include a fluid handling layer of the above described nonwoven fabric.

Still further objects and the broad scope of applicability of the present invention will become apparent to those of skill in the art from the details given hereafter. However, it should be understood that the detailed description of the preferred embodiments of the present invention is only given by way of illustration because various changes and modifications well within the spirit and scope of the invention should become apparent to those of skill in the art in view of the following detailed description.

DETAILED DESCRIPTION OF THE INVENTION

Figure 1:
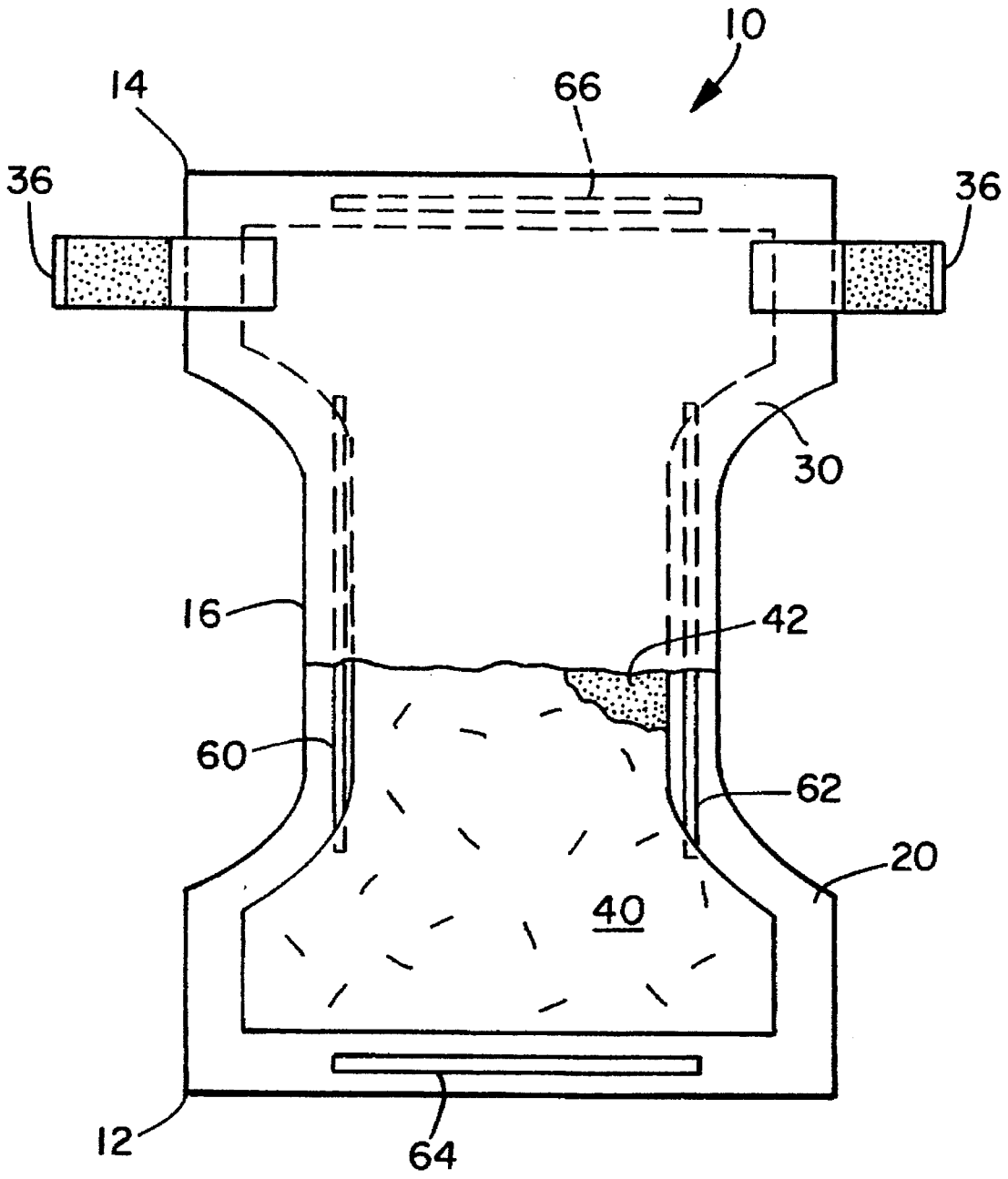
FIG. 1 is a partial plan view of an absorbent diaper-type article made according to a preferred embodiment of the present invention. Portions of some layers of the article have been removed to expose the interior of the article.

The present invention provides a melt-extruded, multicomponent, hydrophilic polymeric strand, a nonwoven fabric made with such polymeric strands, and absorbent articles made with such nonwoven fabric. The nonwoven fabric of the present invention is suitable to make absorbent articles including towels, wipes, and absorbent personal care products including infant care items such as diapers, child care items such as training pants, feminine care items such as sanitary napkins, and adult care items such as incontinence products. The hydrophilic nonwoven fabric of the present invention is particularly suitable for making the fluid handling layers of a disposable diaper such as the liner, surge, transfer and distribution layers of a disposable diaper.

Generally described, the melt-extruded, multicomponent polymeric strand of the present invention includes a first melt-extrudable polymeric component and a second melt-extrudable, hydrophilic polymeric component. The first and second components are arranged in substantially distinct zones across the cross-section of the multicomponent strand and extend continuously along the length of the multicomponent strand. The second component constitutes at least a portion of the peripheral surface of the multicomponent strand continuously along the length of the multicomponent strand.

The multicomponent polymeric strand of the present invention is preferably arranged so that the first and second components are in a sheath/core configuration with the first component forming the core and the second component forming the sheath. The multicomponent polymeric strand of the present invention can also be arranged in a side-by-side configuration; however, the sheath/core configuration tends to result in a more hydrophilic strand because the hydrophilic second component forms the peripheral surface of the strand. The peripheral surface is then hydrophilic and the first component is masked.

The first component of the polymeric strand can be hydrophobic and preferably is a low-cost polymer so that the overall cost of the multicomponent strand is less than if the multicomponent strand was made entirely of the hydrophilic second component. The first component should be melt-extrudable. Melt-extrudable means that the polymer is thermally stable at the melting temperature of the polymer. In other words, a melt-extrudable polymer does not appreciably decompose or cross-link at or below the melting temperature of the polymer.

Suitable melt-extrudable multicomponent polymers for the first component include linear polycondensates and crystalline polyolefins. Preferably, the first component has a first melt viscosity which is higher than the melt viscosity of the second component. Typically, when the melt viscosity of the first component is higher than the melt viscosity of the second component, the multicomponent strand is more easily and consistently melt-spun in the sheath/core configuration. More particularly, suitable polymers for the first component include polypropylene, polyethylene, copolymers of ethylene and propylene, polyethylene terephthalate, and polyamides. ESCORENE PP 3445 polypropylene available from Exxon of Houston, Tex. is particularly preferred.

The second component of the multicomponent polymeric strand of the present invention should be melt-extrudable and hydrophilic. As explained above, hydrophilic is used herein to mean wettable with water or an aqueous solution. Suitable polymers for the second component are those on whose surface water or an aqueous solution will wet-out. Generally, to be wettable, the polymeric component must have a critical surface tension greater than or substantially equal to the surface tension of the liquid. The second component of the multicomponent polymeric strand of the present invention preferably has a critical surface tension greater than about 55 dyne/cm, and more preferably has a critical surface tension at 20° C. greater than about 65 dyne/cm. The second component preferably includes a block copolymer of nylon 6 and polyethylene oxide diamine. Such a block copolymer is available from Allied Signal, Inc. of Petersburg, Va. under the mark HYDROFIL. Other suitable polymers for the second component are ethylene acrylic acid and its neutralized salts. Such polymers are available from Allied Signal, Inc. under the mark ACLYN.

The first component of the multicomponent polymeric strand of the present invention is preferably present in an amount from about 50 to about 95% by weight of the strand and the second component is preferably present in an amount from about 50 to about 5% of the strand. More preferably, the first component of the polymeric strand of the present invention is present in an amount from about 50 to 85% by weight of the strand and the second component is present in an amount from about 50 to about 15% of the strand. Most preferably, the first component includes polypropylene and the second component includes a block copolymer of nylon 6 and polyethylene oxide diamine, the first and second components being present in the foregoing amounts.

The multicomponent polymeric strand of the present invention can be made by conventional melt-extrusion techniques such as melt-spinning. A preferred method of melt-spinning the multicomponent polymeric strands of the present invention and making a nonwoven fabric therewith is disclosed in U.S. Pat. No. 4,340,563 to Appel et al., the disclosure of which is expressly incorporated herein by reference. Although U.S. Pat. No. 4,340,563 discloses only single polymeric component filaments, methods for modifying that disclosure to produce multicomponent filaments are well-known to those of skill in the art. Other suitable processes for making the multicomponent polymeric strands of the present invention are disclosed in U.S. Pat. No. 3,423,266 to Davies et al., U.S. Pat. No. 3,595,731 to Davies et al., and U.S. Pat. No. 3,802,817 to Matsuki et al., the disclosures of which are expressly incorporated herein by reference.

Generally described, the melt-spinning apparatus disclosed in U.S. Pat. No. 4,340,563 includes an extruder for extruding polymeric material through a spin box. The spin box includes a conventional spinneret for making polymeric filaments. The filaments are spun through the spinneret which has one or more rows of openings and formed into a curtain of filaments. The curtain of filaments is directed into a quench chamber extending downwardly from the spin box. Air is introduced into the quench chamber through an inlet port and contacts the filaments. A portion of the quench air is directed through the filament curtain and exhausted through an outlet port opposite the inlet port. The remaining portion of the quench air is directed downwardly through the quench chamber through a smoothly narrowing lower end of the quenching chamber into a nozzle wherein the quench air achieves a higher velocity. The drawing nozzle has a full machine width and is formed by a stationary wall and a moveable wall. The moveable wall moves relative to the stationery wall to control the speed of the air through the nozzle. The quench air directs the curtain of filaments out of the quenching chamber through the nozzle and deposits the filaments on a moving foraminous surface to form a nonwoven web. The nonwoven web can then be bonded by conventional means such as through-air bonding by contacting the nonwoven web with heated air or thermal point bonding.

For the present invention, multicomponent filaments can be made with the foregoing method disclosed in U.S. Pat. No. 4,340,563 by incorporating a conventional extrusion system and spinneret for making multicomponent filaments. Such extrusion systems and spinnerets are well-known to those of ordinary skill in the art.

Through-air bonding and thermal point bonding methods are well-known to those of skill in the art. Generally described, a through-air bonder includes a perforated roll which receives the fabric web and a hood surrounding the perforated roll. Air having a temperature sufficient to soften the second component of the filaments and form bonds between the filaments is directed from the hood, through the fabric web, and into the perforated roll. A thermal point bonder includes a pair of adjacent rolls, one having an array of raised points. One or both of the rolls are heated and the fabric web is passed through the nip between the rolls. The raised points compress, soften and bond the web forming an array of bond points across the web. Thermal point bonding can be conducted in accordance with U.S. Pat. No. 3,855,046, the disclosure of which is expressly incorporated herein by reference.

The following examples are designed to illustrate particular embodiments of the present invention made according to the process disclosed in U.S. Pat. No. 4,340,563 using conventional bicomponent melt-spinning techniques and teach one of ordinary skill in the art how to carry out the present invention.

EXAMPLES 1–6

Six nonwoven fabrics comprising bicomponent polymeric filaments were made according to the process disclosed in U.S. Pat. No. 4,340,563 and conventional bicomponent melt-spinning techniques. The process parameters for Examples 1–6 are set forth in Table 1 along with properties of the resulting nonwoven fabrics.

For each of the Examples 1–6, the first component comprised ESCORENE PP 3445 polypropylene available from Exxon of Houston, Tex. and the second component comprised HYDROFIL LCFX copolymer of nylon 6 and polyethylene oxide diamine available from Allied Signal, Inc. of Petersburg, Va. At 250° C., the HYDROFIL LCFX copolymer had a melt flow rate of 61.6 grams per 10 minutes and a melt density of 0.95 grams per cc, and the ESCORENE PP 3445 polypropylene had a melt flow rate of 54.2 grams/10 minutes and a melt density of 0.73 grams/cc. The Hydrofil LCFX copolymer had a critical surface tension of about 69 dyne/cm based on static contact angle measurement with water at 20° C.

For Examples 1–6, the quench zone had a length of 38 inches and the quench outlet nozzle had a length of 40 inches. The basis weight of each of the fabrics from Examples 1–6 was 1 oz. per square yard. The filaments in Examples 1–5 were arranged in a sheath/core (S/C) configuration and the filaments in Example 6 had a side-by-side (S/S) configuration.

Samples of fabric from Examples 1–6 were tested for absorbency according to the penetration rate test and the runoff test and the results are shown in Table 1.

The process for the penetration rate test is as follows:

A 5×6 inch test sample is placed on a 5×6 inch diaper absorbent pad having a fluff and superabsorbent polymer mixture and then a Lucite plate is placed on the test material. The Lucite plate has dimensions of 5×6×¼ inch with a ¾ inch diameter hole at the center. Extra weight is added onto the Lucite plate to produce a pressure of 0.15 psi on the test material. 50 cc of synthetic urine is poured through the hole of the Lucite plate allowing the fluid to fill but not overflow the hole. After 3 minutes, another 26 cc of synthetic urine is poured through the hole again at a rate to fill but not overflow the hole. The time from the second application of the urine until all the fluid has passed through the material is recorded as the penetration rate. A shorter time means a faster penetration rate.

The fluid run-off test method is as follows:

A 3×6 inch test sample is placed on a 3×4 inch diaper absorbent pad which can absorb at least 6 milliliters of test fluid and both materials are placed on a 30° inclined plane. A polyethylene film is placed loosely on the test sample and is 1 inch away from the point where the test fluid contacts the sample. 60 cc of synthetic urine test fluid is then poured from a separatory funnel with the bottom of the funnel 1 centimeter from the top of the test sample. A beaker is placed under the collecting tube of the inclined plane to collect the test fluid run-off from the test sample. The weight of the fluid run-off is recorded and the procedure is repeated three more times. The absorbent pad is replaced after each fluid insult. The total weight of fluid run-off for the 4 insults is recorded. A lower weight indicates a better penetration performance.

The penetration rate and run-off tests were performed 5 times and the averages of those 5 tests are shown in Table 1. As can be seen from the data in Table 1, the fabric samples from Examples 1–6 were highly wettable and absorbent with synthetic urine. Synthetic urine has a surface tension of about 56 dyne/cm at 20° C. Example 5 shows that filaments in a sheath/core arrangement having the hydrophilic second component present in an amount of only 10% by weight are hydrophilic. It was observed, however, that filaments arranged in a side-by-side configuration having the second component present in an amount less than 50% by weight were considerably less wettable than filaments having a side-by-side configuration with the second component present in an amount of 50% by weight or greater or filaments having a sheath/core configuration.

TABLE 1

| | EXAMPLE 1 | EXAMPLE 2 | EXAMPLE 3 | EXAMPLE 4 | EXAMPLE 5 | EXAMPLE 6 |
|---|---|---|---|---|---|---|
| Configuration | S/C | S/C | S/C | S/C | S/C | S/S |
| Weight % of Second Component | 40 | 30 | 20 | 20 | 10 | 50 |
| 1st Component Melt Temp °F. | 498 | 499 | 499 | 463 | 469 | 458 |
| 2nd Component Melt Temp °F. | 533 | 537 | 540 | 525 | 534 | 505 |
| Quench Air SCFM/In | 35 | 30 | 35 | 35 | 35 | 40 |
| Quench Air Temp °F. | 50 | 50 | 50 | 50 | 51 | 50 |
| Quench Duct Pressure (in $H_2O$) | 22 | 22 | 26 | 30 | 21 | 26 |
| Total Throughput Grams/hole/min | 1.0 | 1.0 | 1.0 | 1.0 | 1.0 | 0.75 |
| Denier | 9.2 | 10.1 | 6.1 | 4.9 | 6.6 | 4.9 |
| Penetration Rate (sec) | 47.3 | 38.8 | 48.8 | 48.3 | 46.7 | 37.3 |
| Run-off (g) | 0.00 | 0.00 | 0.00 | 0.00 | 0.00 | 0.07 |

Turning to FIG. 1, a disposable diaper-type article 10 made according to a preferred embodiment of the present invention is shown. The diaper 10 includes a front waistband panel section 12, a rear waistband panel section 14, and an intermediate section 16 which interconnects the front and rear waistband sections. The diaper comprises a substantially liquid impermeable outer cover layer 20, a liquid permeable liner layer 30, and an absorbent body 40 located between the outer cover layer and the liner layer. Fastening means, such as adhesive tapes 36 are employed to secure the diaper 10 on a wearer. The liner 30 and outer cover 20 are bonded to each other and to absorbent body 40 with lines and patterns of adhesive, such as a hot-melt, pressure-sensitive adhesive. Elastic members 60, 62, 64 and 66 can be configured about the edges of the diaper for a close fit about the wearer.

The outer cover layer 20 is composed of a substantially liquid impermeable material such as a polymer film comprising polyethylene, polypropylene or the like. The outer cover layer 20 may alternatively be composed of a nonwoven fibrous web constructed to provide the desired levels of liquid impermeability.

The liner layer 30 preferably comprises the permanently hydrophilic nonwoven fabric of the present invention. The absorbent body 40 may also be made of the permanently hydrophilic nonwoven fabric of the present invention. It is desirable that both the liner layer 30 and the absorbent body 40 be hydrophilic to absorb and retain aqueous fluids such as urine. Although not shown in FIG. 1, the disposable diaper 10 may include additional fluid handling layers such as a surge layer, a transfer layer or a distribution layer. These layers may be separate layers or may be integral with the liner layer 20 or the absorbent pad 40. The diaper 10 may include various combinations of layers made with the permanently hydrophilic nonwoven material of the present invention and other conventional hydrophilic materials. For example, one or more of the fluid handling layers of the diaper 10 may be made of normally hydrophobic materials which have been treated to become hydrophilic and the absorbent body 40 may comprise cellulosic fibers which are naturally hydrophilic.

Although the absorbent article 10 shown in FIG. 1 is a disposable diaper, it should be understood that the nonwoven fabric of the present invention may be used to make a variety of absorbent articles such as those identified above.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

We claim:

1. A permanently hydrophilic nonwoven fabric comprising melt-extruded multicomponent polymeric strands including a first melt-extrudable polymeric component and a second component comprising a melt-extrudable, hydrophilic polymer having a critical surface tension at 20° C. greater than about 55 dynes/cm, the multicomponent strands having a cross-section, a length, and a peripheral surface, the first and second components being arranged in substantially distinct zones across the cross-section of the multicomponent strands and extending continuously along the length of the multicomponent strands, the second multicomponent constituting at least a portion of the peripheral surface of the multicomponent strands continuously along the length of the multicomponent strands.

2. A nonwoven fabric as in claim 1 wherein the first and second components are arranged in a sheath/core configuration, the first component forming the core and the second component forming the sheath.

3. A nonwoven fabric as in claim 1 wherein the second component has a critical surface tension at 20° C. greater than about 65 dyne/cm.

4. A nonwoven fabric as in claim 1 wherein the second component comprises a block copolymer of nylon 6 and polyethylene oxide diamine.

5. A nonwoven fabric as in claim 1 wherein the first component is hydrophobic.

6. A nonwoven fabric as in claim 1 wherein the first component is selected from the group consisting of linear polycondensates and crystalline polyolefins.

7. A nonwoven fabric as in claim 1 wherein the first component comprises a polymer selected from the group consisting of polypropylene, polyethylene, copolymers of ethylene and propylene, polyethylene terephthalate, and polyamides.

8. A nonwoven fabric as in claim 1 wherein the first component comprises a polymer selected from the group consisting of polypropylene, polyethylene, copolymers of ethylene and propylene, polyethylene terephthalate, and polyamides and the second component comprises a block copolymer of nylon 6 and polyethylene oxide diamine.

9. A nonwoven fabric as in claim 1 wherein the first and second components are arranged in a sheath/core configuration, the first component forming the core and the second component forming the sheath.

10. A nonwoven fabric as in claim 1 wherein the first component is present in an amount from about 50 to about 95% by weight of the strands and the second component is present in an amount from about 50 to about 5% of the strands.

11. A nonwoven fabric as in claim 1 wherein the first component is present in an amount from about 50 to about 85% by weight of the strands and the second component is present in an amount from about 50 to about 15% of the strands.

12. A nonwoven fabric as in claim 9 wherein the first component is present in an amount from about 50 to about 95% by weight of the strands and the second component is present in an amount from about 50 to about 5% of the strands.

13. A nonwoven fabric as in claim 9 wherein the first component is present in an amount from about 50 to about 85% by weight of the strands and the second component is present in an amount from about 50 to about 15% of the strands.

14. An absorbent article comprising a fluid handling layer of a permanently hydrophilic nonwoven fabric comprising melt-extruded multicomponent polymeric strands including a melt-extrudable polymeric component and a second component comprising a melt-extrudable, hydrophilic polymer having a critical surface tension at 20° C. greater than about 55 dynes/cm, the multicomponent strands having a cross-section, a length, and a peripheral surface, the first and second components being arranged in substantially distinct zones across the cross-section of the multicomponent strands and extending continuously along the length of the multicomponent strands, the second component constituting at least a portion of the peripheral surface of the multicomponent strands continuously along the length of the multicomponent strands.

15. An absorbent article as in claim 14 wherein the first and second components are arranged in a sheath/core configuration, the first component forming the core and the second component forming the sheath.

16. An absorbent article as in claim 14 wherein the second component has a critical surface tension at 20° C. greater than about 65 dyne/cm.

17. An absorbent article as in claim 14 wherein the second component comprises a block copolymer of nylon 6 and polyethylene oxide diamine.

18. An absorbent article as in claim 14 wherein the first component is hydrophobic.

19. An absorbent article as in claim 14 wherein the first component is selected from the group consisting of linear polycondensates and crystalline polyolefins.

20. An absorbent article as in claim 14 wherein the first component comprises a polymer selected from the group consisting of polypropylene, polyethylene, copolymers of ethylene and propylene, polyethylene terephthalate, and polyamides.

21. An absorbent article as in claim 14 wherein the first component comprises a polymer selected from the group consisting of polypropylene, polyethylene, copolymers of ethylene and propylene, polyethylene terephthalate, and polyamides and the second component comprises a block copolymer of nylon 6 and polyethylene oxide diamine.

22. An absorbent article as in claim 21 wherein the first and second components are arranged in a sheath/core configuration, the first component forming the core and the second component forming the sheath.

23. An absorbent article as in claim 14 wherein the first component is present in an amount from about 50 to about 95% by weight of the strands and the second component is present in an amount from about 50 to about 5% of the strands.

24. An absorbent article as in claim 14 wherein the first component is present in an amount from about 50 to about 85% by weight of the strands and the second component is present in an amount from about 50 to about 15% of the strands.

25. An absorbent article as in claim 22 wherein the first component is present in an amount from about 50 to about 95% by weight of the strands and the second component is present in an amount from about 50 to about 5% of the strands.

26. An absorbent article as in claim 22 wherein the first component is present in an amount from about 50 to about 85% by weight of the strands and the second component is present in an amount from about 50 to about 15% of the strands.

27. An absorbent article as in claim 14 wherein the absorbent article is an adult incontinence product.

28. An absorbent article as in claim 14 wherein the absorbent article is an infant diaper.

29. An absorbent article as in claim 14 wherein the absorbent article is a wipe.

30. An absorbent article as in claim 14 wherein the absorbent article is a towel.

31. An absorbent article as in claim 14 wherein the absorbent article is a training pant.

32. An absorbent article as in claim 14 wherein the absorbent article is a feminine care absorbent product.

* * * * *

UNITED STATES PATENT AND TRADEMARK OFFICE

CERTIFICATE OF CORRECTION

PATENT NO. : 5,643,662

DATED : July 1, 1997

INVENTOR(S) : Yeo et al.

It is certified that error appears in the above-identified patent and that said Letters Patent is hereby corrected as shown below:

Page 3, FOREIGN PATENT DOCUMENTS, add:

--1305293 7/1992 Canada--;
--1307923 8/1992 Canada--;
--2060702 8/1992 Canada--;
--1208098 7/1986 Canada--;
--0 070 163 7/1982 European Pat. Off.--;
--1045047 2/1964 United Kingdom--;
--1073182 3/1963 United Kingdom--;
--1073183 2/1963 United Kingdom--;
--1092372 7/1963 United Kingdom--;
--1092373 7/1963 United Kingdom--;
--1130996 10/1968 United Kingdom--;
--1149270 11/1966 United Kingdom--;
--1196586 10/1966 United Kingdom--;
--1197966 12/1967 United Kingdom--;
--1209635 12/1969 United Kingdom--;
--1234506 9/1970 United Kingdom--;
--1245088 9/1971 United Kingdom--;
--1300813 12/1972 United Kingdom--;

Column 2, line 44, "mole" should read –more--;

Column 9, line 27, "1" should read --8--;

Column 1, line 6, "07/974,554 filed" should read --07/974,554 entitled "Hydrophilic, Multicomponent Polymeric Strands And Nonwoven Fabrics Made Therewith" and filed--;

UNITED STATES PATENT AND TRADEMARK OFFICE

CERTIFICATE OF CORRECTION

PATENT NO. : 5,643,662

DATED : July 1, 1997

INVENTOR(S) : Yeo et al.

It is certified that error appears in the above-identified patent and that said Letters Patent is hereby corrected as shown below:

Column 10, add claim --33. A nonwoven fabric as in Claim 1 wherein the second component comprises ethylene acrylic acid.--;
Column 10, add claim --34. A nonwoven fabric as in Claim 1 wherein the second component comprises a neutralized salt of ethylene acrylic acid.--;
Column 10, add claim --35. An absorbent article as in Claim 14 wherein the second component comprises ethylene acrylic acid.--;
Column 10, add claim --36. An absorbent article as in Claim 14 wherein the second component comprises a neutralized salt of ethylene acrylic acid.--.

Signed and Sealed this

Twenty-seventh Day of October, 1998

*Attest:*

Bruce Lehman

BRUCE LEHMAN

*Attesting Officer*

*Commissioner of Patents and Trademarks*